US007919912B2

(12) United States Patent
Kim

(10) Patent No.: US 7,919,912 B2
(45) Date of Patent: Apr. 5, 2011

(54) ELECTRON EMISSION SOURCE, COMPOSITION FOR FORMING ELECTRON EMISSION SOURCE, METHOD OF FORMING THE ELECTRON EMISSION SOURCE AND ELECTRON EMISSION DEVICE INCLUDING THE ELECTRON EMISSION SOURCE

(75) Inventor: Joo-Young Kim, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 882 days.

(21) Appl. No.: 11/734,393

(22) Filed: Apr. 12, 2007

(65) Prior Publication Data

US 2007/0252506 A1 Nov. 1, 2007

(30) Foreign Application Priority Data

Apr. 26, 2006 (KR) ..... 10-2006-0037683

(51) Int. Cl.
*H01K 1/06* (2006.01)

(52) U.S. Cl. ..... 313/346 R; 313/355; 428/447; 428/450; 524/424; 427/387

(58) Field of Classification Search ..... None
See application file for complete search history.

(56) References Cited

U.S. PATENT DOCUMENTS 5,336,736 A 8/1994 Nakano et al.

(Continued)

FOREIGN PATENT DOCUMENTS

JP 2004-281166 A * 7/2004

(Continued)

OTHER PUBLICATIONS

Abstract for JP 2004-281166 A.*

(Continued)

*Primary Examiner* — Marc S Zimmer
(74) *Attorney, Agent, or Firm* — Christie, Parker & Hale, LLP

(57) ABSTRACT

An electron emission source includes a carbon-based material and resultant material formed by curing and heat treating at least one silicon-based material represented by formula (1), (2), and/or (3) below:

formula (1)

formula (2)

formula (3)

where $R_1$ through $R_{22}$ are each independently a substituted or unsubstituted C1-C20 alkyl group, a substituted or unsubstituted C1-C20 alkoxy group, a substituted or unsubstituted C1-C20 alkenyl group, a halogen atom, a hydroxyl group or a mercapto group, and m and n are each integers from 0 to 1,000. An electron emission device and an electron emission display device include the electron emission source. A composition for forming electron emission sources includes the carbon-based material and the silicon-based material. A method of forming the electron emission source includes applying the composition to a substrate; and heat treating the applied composition. The adhesion between the electron emission source including the cured and heat treated resultant material of the silicon-based material and a substrate is excellent, and thus the reliability of the electron emission device including the cured and heat treated resultant material of the silicon-based material can be enhanced.

17 Claims, 4 Drawing Sheets

U.S. PATENT DOCUMENTS

| | | | | |
|---|---|---|---|---|
| 6,436,221 | B1 | 8/2002 | Chang et al. | |
| 7,183,363 | B2 * | 2/2007 | Jennrich et al. | 525/476 |
| 2005/0179355 | A1 | 8/2005 | Yoo et al. | |
| 2005/0194881 | A1 | 9/2005 | Nam et al. | |
| 2005/0242344 | A1 | 11/2005 | Lee et al. | |
| 2006/0214560 | A1 * | 9/2006 | Noguchi et al. | 313/498 |
| 2007/0029917 | A1 * | 2/2007 | Hong et al. | 313/495 |
| 2007/0095665 | A1 * | 5/2007 | Hsiao et al. | 204/450 |
| 2007/0262687 | A1 * | 11/2007 | Li | 313/311 |
| 2009/0322258 | A1 * | 12/2009 | Nguyen | 315/326 |

FOREIGN PATENT DOCUMENTS

| | | | |
|---|---|---|---|
| JP | 2006-73510 | | 3/2006 |
| WO | WO 02/40589 | * | 5/2002 |

OTHER PUBLICATIONS

Machine-generated translation of JP 2004-281166 A.*

Definition of "silicone oil" as defined by Hawley's Condensed Chemical Dictionary, 14th edition (2002) published by John Wiley & sons Inc.*

Gu, C. Z., et al., "Field electron emission from carbon nanotubes coated on $TiSi_2$ buffer layer", Technical Digest of the 17$^{th}$ International Vacuum Nanoelectronics Conference 2004, Jul. 10, 2005, pp. 60-61.

Office Action issued in corresponding European Patent Application No. 07106787.0 dated Nov. 5, 2007.

* cited by examiner

ELECTRON EMISSION SOURCE, COMPOSITION FOR FORMING ELECTRON EMISSION SOURCE, METHOD OF FORMING THE ELECTRON EMISSION SOURCE AND ELECTRON EMISSION DEVICE INCLUDING THE ELECTRON EMISSION SOURCE

CROSS-REFERENCE TO RELATED APPLICATIONS

This application claims the benefit of Korean Application No. 2006-37683, filed Apr. 26, 2006, in the Korean Intellectual Property Office, the disclosure of which is incorporated herein by reference.

BACKGROUND OF THE INVENTION

1. Field of the Invention

Aspects of the present invention relate to an electron emission source, a composition for forming the electron emission source, a method of forming the electron emission source and an electron emission device including the electron emission source. More particularly, aspects of the present invention relate to an electron emission source including a carbon-based material, and a cured and heat treated silicon-based material, a composition for forming the electron emission source, a method of forming the electron emission source and an electron emission device including the electron emission source. The electron emission source includes the carbon-based material, and the cured and heat treated silicon-based material. Thereby, improved adhesion with a substrate can be obtained.

2. Description of the Related Art

Generally, electron emission devices use a hot cathode or a cold cathode as an electron emission source. Examples of electron emission devices using a cold cathode include a field emitter array (FEA) type, a surface conduction emitter (SCE) type, a metal insulator metal (MIM) type, a metal insulator semiconductor (MIS) type, and a ballistic electron surface emitting (BSE) type.

The FEA type of electron emission device utilizes the principle that when a material with a low work function or a high β function is used as an electron emission source, electrons are easily emitted in a vacuum due to an electric field difference. FEA devices that include a tip structure primarily composed of Mo, Si, etc., and having a sharp end, and carbon-based materials such as graphite, diamond like carbon (DLC), etc., as electron emission sources have been developed. Recently, nanomaterials such as nanotubes and nanowires have been used as electron emission sources.

The SCE type of electron emission device is formed by interposing a conductive thin film between a first electrode and a second electrode which are arranged on a first substrate so as to face each other and producing microcracks in the conductive thin film. When voltages are applied to the first and second electrodes and an electric current flows along the surface of the conductive thin film, electrons are emitted from the microcracks constituting electron emission sources.

The MIM type and the MIS type of electron emission device include a metal-insulator-metal structure and a metal-insulator-semiconductor structure, respectively, as an electron emission source. When voltages are applied to the two metals in the MIM type or to the metal and the semiconductor in the MIS type, electrons are emitted while migrating and accelerating from the metal or the semiconductor having a high electron potential to the metal having a low electron potential.

The BSE type of electron emission device utilizes the principle that when the size of a semiconductor is reduced to less than the mean free path of electrons in the semiconductor, electrons travel without scattering. An electron-supplying layer composed of a metal or a semiconductor is formed on an ohmic electrode, and then an insulating layer and a metal thin film are formed on the electron-supplying layer. When voltages are applied to the ohmic electrode and the metal thin film, electrons are emitted.

FEA type electron emission devices can be categorized as top gate types and an under gate types according to the arrangement of the cathode and gate electrode and can be categorized as diodes, triodes, tetrodes, etc., according to the number of electrodes used.

Electron emission sources in the electron emission devices described above can be composed of carbon-based materials, such as, for example, carbon nanotubes. Carbon nanotubes have excellent conductivity and electric field focusing effects, small work functions, and excellent electric field emission characteristics, and thus can function at a low driving voltage and can be used for large displays. For these reasons, carbon nanotubes are considered an ideal electron emission material for electron emission sources.

Methods of forming electron emission sources containing carbon nanotubes include, for example, a carbon nanotube growing method using chemical vapor deposition (CVD), etc., and a paste method using a composition that contains carbon nanotubes and a vehicle. When using the paste method, manufacturing costs decrease, and large-area electron emission sources can be obtained. Examples of the composition for forming electron emission sources that contains carbon nanotubes are disclosed, for example, in U.S. Pat. No. 6,436,221.

However, when an electron emission source is formed on a substrate using a conventional paste method, the electron emission source may become delaminated from the substrate in the process of developing the composition for forming electron emission sources, or activating the vertical alignment of the carbon-based material of the electron emission source. Therefore, a solution that overcomes these problems is desirable.

SUMMARY OF THE INVENTION

Aspects of the present invention provide an electron emission source including a carbon-based material, and a cured and heat treated silicon-based material, a composition for forming electron emission sources, a method of forming the electron emission source and an electron emission device including the electron emission source.

According to an aspect of the present invention, there is provided an electron emission source including a carbon-based material and a resultant material formed by curing and heat treating a silicon-based material, wherein the silicon-based material is at least one of a silicon-based material represented by formula (1) below, a silicon-based material represented by formula (2) below and a silicon-based material represented by formula (3) below:

formula (1)

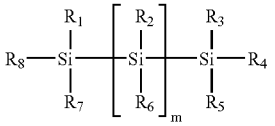

-continued formula (2)

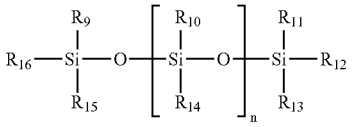

formula (3)

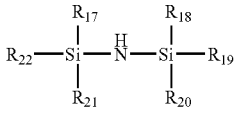

where $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$ and $R_{22}$ are each independently a substituted or unsubstituted $C_1$-$C_{20}$ alkyl group, a substituted or unsubstituted $C_1$-$C_{20}$ alkoxy group, a substituted or unsubstituted $C_1$-$C_{20}$ alkenyl group, a halogen atom, a hydroxyl group or a mercapto group, and m and n are each independently integers from 0 to 1,000.

According to another aspect of the present invention, there is provided a composition for forming electron emission sources, the composition including: a carbon-based material; and a silicon-based material, wherein the silicon based material is at least one of a silicon-based material represented by formula (1), a silicon-based material represented by formula (2) and a silicon-based material represented by formula (3); and a vehicle:

formula (1)

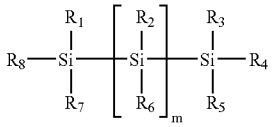

formula (2)

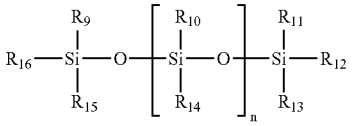

formula (3)

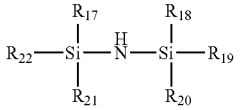

where R1, R2, R3, R4, R5, R6, R7, R8, R9, R10, R11, R12, R13, R14, R15, R16, R17, R18, R19, R20, R21 and R22 are each independently a substituted or unsubstituted C1-C20 alkyl group, a substituted or unsubstituted $C_1$-$C_{20}$ alkoxy group, a substituted or unsubstituted $C_1$-$C_{20}$ alkenyl group, a halogen atom, a hydroxyl group or a mercapto group, and m and n are each independently integers from 0 to 1,000.

According to another aspect of the present invention, there is provided a method for forming an electron emission source, the method including: preparing the composition for forming electron emission sources as described above; applying the composition for forming electron emission sources to a substrate; and heat treating the applied composition for forming electron emission sources on the substrate.

According to another aspect of the present invention, there is provided an electron emission device including: a substrate; a cathode and an electron emission source arranged on the first substrate; a gate electrode disposed to be electrically insulated from the cathode; and an insulating layer arranged between the cathode and the gate electrode to insulate the cathode from the gate electrode, wherein the electron emission source is the electron emission source as described above.

According to another aspect of the present invention, there is provided an electron emission display device comprising: a first substrate; a cathode and an electron emission source arranged on the first substrate; a gate electrode disposed to be electrically insulated from the cathode; an insulating layer arranged between the cathode and the gate electrode to insulate the cathode from the gate electrode, a second substrate arranged to be substantially parallel with the first substrate and comprising an anode and a phosphor layer; wherein the electron emission source is as described above.

An adhesion of an electron emission source according to aspects of the present invention with a substrate is excellent. In addition, in case of forming an electron emission source using a composition for forming electron emission sources according to the present invention, when a composition for forming electron emission sources is developed and/or is activated for vertical alignment of carbon-based material after heat treatment, a delamination of electron emission source from a substrate can be inhibited. Therefore, an electron emission device having an improved reliability is obtained.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
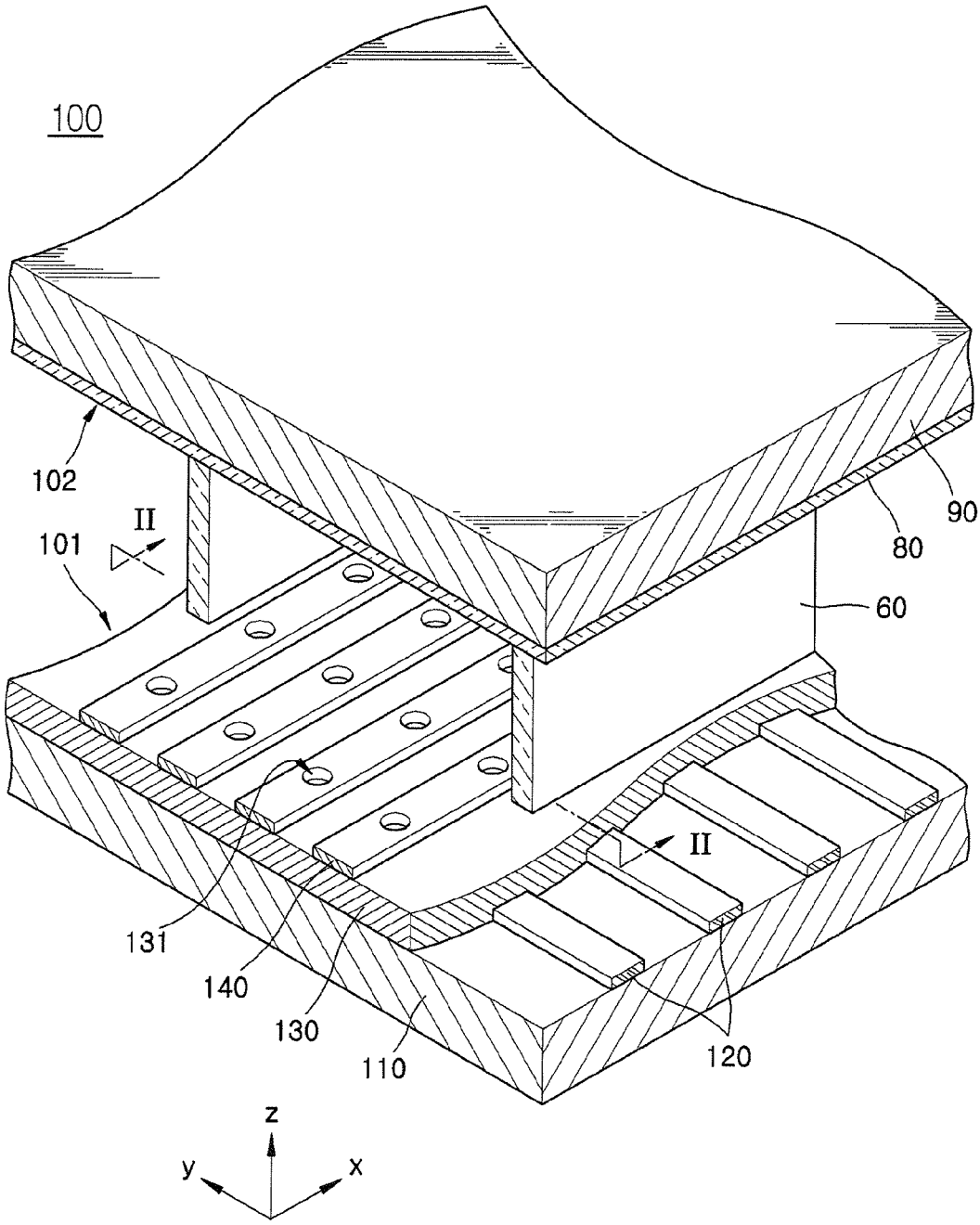
FIG. 1 is a schematic perspective view of a structure of a top gate type electron emission display device according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

An electron emission source according to an embodiment of the present invention includes a carbon-based material and a resultant material formed by curing and heat treating at least one of a silicon-based material represented by formula (1), a silicon-based material represented by formula (2) and a silicon-based material represented by formula (3), below. The silicon-based material represented by formula (1), silicon-based material represented by formula (2) and silicon-based material represented by formula (3) may be referred to collectively herein as "the silicon-based material."

The carbon-based material, which has good conductivity and electron emission characteristics, emits electrons to a phosphor layer to excite phosphors when an electron emission device is operated. Examples of the carbon-based material include carbon nanotubes, graphite, diamond, fullerene, silicon carbide (SiC), etc., but are not limited thereto. As a specific non-limiting example, the carbon-based material may be carbon nanotubes.

Carbon nanotubes are carbon allotropes prepared by rolling graphite sheets to form tubes with nanometer-sized diameters. Both single-wall nanotubes and multi-wall nanotubes can be used. The carbon nanotubes can be prepared using chemical vapor deposition (hereinafter, also called "CVD"), such as DC plasma CVD, RF plasma CVD, or microwave plasma CVD.

The electron emission source according to an embodiment of the present invention includes a resultant material formed by curing and heat treating at least one of a silicon-based material represented by formula (1) below, a silicon-based material represented by formula (2) below and a silicon-based material represented by formula (3) below:

formula (1)

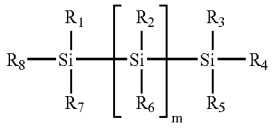

formula (2)

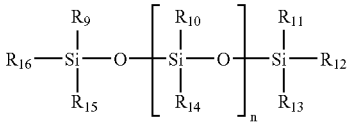

formula (3)

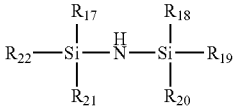

The cured and heat treated resultant material as described above increases the adhesion between the electron emission source and the substrate, such as, for example, an ITO cathode. Accordingly, the cured and heat treated resultant material helps to prevent an electron emission source according to an embodiment of the present invention from delaminating from a substrate. Thereby, the durability of an electron emission device including the electron emission source can be increased.

Throughout this specification, the terms "resultant material" and "cured and heat treated resultant material" refer to a material obtained by curing and heat treating at least one of a silicon-based material represented by formula (1), a silicon-based material represented by formula (2) and a silicon-based material represented by formula (3), as will be described below. In particular, the silicon-based material may be heat treated at a temperature of 400-500° C. after curing the silicon-based material using ultra violet (UV) rays or heat. The curing and heat treating may take place while the silicon-based material is in a composition with other materials such as a carbon-based material and a vehicle, as described below. Moreover, the curing and heat-treating may comprise a single operation.

In the above formulas (1), (2) and (3), $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$ and $R_{22}$ are each independently a substituted or unsubstituted $C_1$-$C_{20}$ alkyl group, a substituted or unsubstituted $C_1$-$C_{20}$ alkoxy group, a substituted or unsubstituted $C_1$-$C_{20}$ alkenyl group, a halogen atom, a hydroxyl group or a mercapto group, or, as a more particular, non-limiting example, may be independently a substituted or unsubstituted $C_1$-$C_{10}$ alkyl group, a substituted or unsubstituted $C_1$-$C_{10}$ alkoxy group, a substituted or unsubstituted $C_1$-$C_{10}$ alkenyl group or a halogen atom.

When the alkyl group, alkoxy group or alkenyl group are substituted, the substituent group may be at least one selected from the group consisting of, for example, an amino group, a hydroxyl group, a halogen atom, a carboxyl group, an epoxy group, a $C_1$-$C_{20}$ alkoxy group, and a $C_6$-$C_{20}$ cycloalkyl group, but is not limited thereto.

In the above formulas (1) and (2), m and n are each independently integers from 0 to 1000. Moreover, m and n can vary within the silicon-based material so that the silicon-based material has a weight average molecular weight within the range described below. As a specific, non-limiting example, m and n can range from 0 to 50.

The silicon-based material may have a weight average molecular weight of 100-100,000, or, as a more particular, non-limiting example, 1,000-10,000. When the weight average molecular weight of the silicon-based material is less than 100, the adhesion between an electron emission source and a substrate may not be sufficiently increased. When the weight average molecular weight of the silicon-based material is more than 100,000, the silicon-based material may not be dispersed effectively onto a composition for forming electron emission sources.

In particular, the silicon-based material represented by formula (1) may be a compound represented by formula (1a) below, but is not limited thereto:

formula (1a)

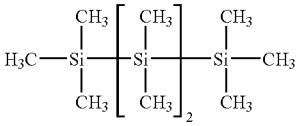

The silicon-based material represented by formula (2) may be a compound represented by formula (2a) below, but is not limited thereto:

formula (2a)

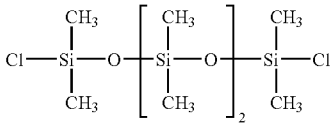

The silicon-based material represented by formula (3) may be the compound represented by formula (3a), but is not limited thereto:

formula (3a)

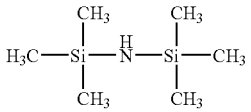

In addition, it will be understood that various changes in silicon-based material represented by formulas (1), (2) or (3)

may be made without departing from the scope of the present invention as described above. For example, the silicon-based material that is cured and heat treated may be a mixture of silicon-based materials represented by formulas (1), (2) or (3) having a variety of selections for $R_1$-$R_{22}$, m and n.

A method of manufacturing an electron emission source according to an embodiment of the present invention may include: preparing a composition for forming electron emission sources that includes, for example, a carbon-based material, a silicon-based material as described above and a vehicle; applying the composition to a substrate; and heat treating the applied composition on the substrate.

First, a composition for forming electron emission sources, which includes carbon-based material; at least one of the silicon-based materials represented by formula (1), formula (2) and formula (3); and a vehicle, is prepared. Detailed descriptions of the carbon-based material and silicon-based material represented by formulas (1) through (3) above have been provided above.

The amount of the silicon-based material may be 20-400 parts by weight based on 100 parts by weight of the carbon-based material, or, as a more particular, non-limiting example, may be 33-330 parts by weight. When the amount of the silicon-based material is less than 20 parts by weight based on 100 parts by weight of the carbon-based material, the adhesion between an electron emission source and a substrate may not be sufficiently increased. When the amount of the silicon-based material is more than 400 parts by weight based on 100 parts by weight of the carbon-based material, the amount of carbon-based material is decreased relatively. Also, the electric field emission property of the electron emission source may be degraded, and the photosensitivity of the silicon-based material may be reduced. This may result in poor electron emission source pattern resolution.

The vehicle included in the composition for forming electron emission sources adjusts the printability and viscosity of the composition and carries the carbon-based material and a photoelectric element. The vehicle may include a resin component and a solvent component.

The resin component may include, but is not limited to, at least one of a plurality of cellulose-based resins, such as ethyl cellulose, nitro cellulose, etc., acryl-based resins, such as polyester acrylate, epoxy acrylate, urethane acrylate, etc., and vinyl-based resins, such as polyvinyl acetate, polyvinyl butyral, polyvinyl ether, etc. Some of the above-listed resin components also can act as photosensitive resins.

The solvent component may include at least one of, for example, terpineol, butyl carbitol (BC), butyl carbitol acetate (BCA), toluene, and texanol. As a specific, non-limiting example, the solvent component may be terpineol.

The amount of the resin component may be 100-500 parts by weight, or, as a more particular, non-limiting example, may be 200-300 parts by weight, based on 100 parts by weight of the carbon-based material. The amount of the solvent component may be 500-1500 parts by weight, preferably 800-1200 parts by weight, based on 100 parts by weight of the carbon-based material. When the amounts of the resin component and the solvent component are not within the above-described ranges, the printability and the flowability of the composition may be worsened. In particular, when the amounts of the resin component and the solvent component exceed the above-described ranges, the drying time may be too long.

The composition for forming electron emission sources according to the current embodiment of the present invention may further include a photosensitive resin, a photoinitiator, an adhesive component, and a filler, etc.

The photosensitive resin is used to pattern the electron emission sources. Non-limiting examples of the photosensitive resin include an acrylate-based monomer, a benzophenone-based monomer, an acetophenone-based monomer, a thioxanthone-based monomer, etc. In particular, epoxy acrylate, polyester acrylate, methyl acrylate, ethylacrylate, n-propylacrylate, isopropylacrylate, n-butylacrylate, sec-butylacrylate, iso-butylacrylate, allylacrylate, benzylacrylate, butoxyethylacrylate, butoxytriethyleneglycolacrylate, glycerolacrylate, glycidylacrylate, 2-hydroxyethylacrylate, isobornylacrylate, 2-hydroxypropylacrylate, 2,4-diethylxanthone, or 2,2-dimethoxy-2-phenylacetophenone, etc., may be used.

The amount of the photosensitive resin may be 300-1000 parts by weight, or, as a more particular, non-limiting example, may be 500-800 parts by weight, based on 100 parts by weight of the carbon-based material. When the amount of the photosensitive resin is less than 300 parts by weight based on 100 parts by weight of the carbon-based material, the exposure sensitivity decreases. When the amount of the photosensitive resin is greater than 1000 parts by weight based on 100 parts by weight of the carbon-based material, developing may not be performed effectively.

The composition for forming electron emission sources according to the current embodiment of the present invention may further include a photoinitiator. The photoinitiator initiates cross-linking of the photosensitive resin when exposed to light and may be a well-known material. Examples of the photoinitiator may include benzophenone, o-benzoyl benzoic acid methyl, 4,4-bis(dimethyl amine)benzophenone, 4,4-bis (diethylamino)benzophenone, 4,4-dichlorobenzophenone, 4-benzoyl-4-methyl diphenylketone, dibenzylketone, 2,2-diethoxyacetophenone, 2,2-dimethoxy-2-phenylacetophenone, 2-hydroxy-2-methyl propiophenone, thioxanthone, 2-methyl thioxanthone, 2-chlorothioxanthone, 2-isopropylthioxanthone, diethylthioxanthone, benzyldimethyl ketanol, benzylmethoxyethylacetal, etc.

The amount of the photoinitiator may be 300-1000 parts by weight, or, as a more particular, non-limiting example, may be 500-800 parts weight, based on 100 parts by weight of the carbon-based material. When the amount of the photoinitiator is less than 300 parts by weight based on 100 parts by weight of the carbon-based material, crosslinking may not be effective to form patterns. When the amount of the photoinitiator is greater than 1000 parts by weight based on 100 parts by weight of the carbon-based material, the manufacturing costs rise.

The adhesive component adheres the composition to the substrate on which the electron emission sources are to be formed. The adhesive component may be, for example, an inorganic binder, etc. Non-limiting examples of the inorganic binder include frit, silane, water glass, etc. A combination of at least two of these inorganic binders can be used. As a specific, non-limiting example, the inorganic binder may be a frit, such as a frit composed of PbO, ZnO, or $B_2O_3$.

The amount of the inorganic binder in the composition for forming electron emission sources may be 10-50 parts by weight, or, as a more particular, non-limiting example, may be 15-35 parts by weight, based on 100 parts by weight of the carbon-based material. When the amount of the inorganic binder is less than 10 parts by weight based on 100 parts by weight of the carbon-based material, the adhesion may not be sufficiently strong. When the amount of the inorganic binder is greater than 50 parts by weight, the printability may be worsened.

The filler improves the conductivity of the carbon-based material wherever it is not strongly adhered to the substrate. Non-limiting examples of the filler include Ag, Al, Pd, etc.

The viscosity of the composition for forming electron emission sources according to the current embodiment of the present invention, which contains the above-described materials, may be 3,000-50,000 cps, or, as a more particular, non-limiting example, may be 5,000-30,000 cps. When the viscosity of the composition does not lie within the above range, the workability of the composition may be worsened.

Next, the composition for forming electron emission sources is applied to the substrate. The substrate on which electron emission sources will be formed may vary according to the type of electron emission device to be formed, as would be obvious to one of skill in the art. For example, when manufacturing an electron emission device with gate electrodes between a cathode and an anode, the substrate may be the cathode.

The application of the composition for forming electron emission sources to the substrate may vary according to whether or not photosensitive resins are included in the composition. Additional photoresist patterns are unnecessary when the composition for forming electron emission sources includes photosensitive resins. That is, after coating a composition for forming electron emission sources that includes photosensitive resins onto the substrate, exposing (for example, UV exposing), curing and developing the composition for forming electron emission sources are performed to define objective electron emission source regions.

A photolithography process using additional photoresist patterns should be carried out when the composition for forming electron emission sources does not include photosensitive resins. That is, after photoresist patterns are formed on the substrate using a photoresist film, the composition for forming electron emission sources is applied to the substrate on which the photoresist patterns have been formed. Next, a curing process using heat or light is performed on the composition for forming electron emission sources to define desired electron emission source regions.

In a process of developing, the composition for forming electron emission sources including the silicon-based material as described above can form a cured composition according to electron emission source patterns that is less likely to delaminate from the substrate. In a developing operation, an portion of the composition for forming electron emission sources that is not cured is removed. At this point, if a composition for forming an electron emission source is used that is not according to an embodiment of the present invention, there is a likelihood that some of the cured composition will be removed when the uncured portion is removed. However, a composition for forming electron emission sources according to an embodiment of the present invention includes the silicon-based material as describe herein, and thus, the cured composition for forming electron emission sources part adheres firmly to the substrate during developing and removal of the uncured portion.

The composition for forming electron emission sources applied to the substrate is heat treated as described above. The adhesion between the carbon-based material in the composition for forming electron emission sources and the substrate is increased due to the heat treatment. Vehicle components are volatilized, and inorganic materials such as binders, etc., are melted and solidified to enhance the durability of the electron emission source. The heat treatment temperature should be determined according to the volatilization temperature and volatilization time of a vehicle included in the composition for forming electron emission sources. A general heat treatment temperature is 400-500° C., or, as a more particular, non-limiting example, may be 450° C. When the heat treatment temperature is less than 400° C., volatilization of the vehicle may not be sufficient. When the heat treatment temperature is greater than 500° C., the manufacturing costs may increase and the substrate may be damaged.

The heat treatment may be performed in an inert gas atmosphere in order to inhibit degradation of the carbon-based material. The inert gas may be, for example, nitrogen gas, argon gas, neon gas, xenon gas or a mixed gas of at least two of the aforementioned gases.

As described above, the electron emission source according to aspects of the present invention is cured and heat treated. Accordingly, silicon-based material included in the composition for forming the electron emission source is transformed physically and chemically due to the curing and heat treatment. Thus cured and heat treated resultant material may be included in the electron emission source according to an aspect of the present invention.

The surface of heat treated resultant material may be additionally processed to provide vertical alignment and surface exposure of the carbon-based material. According to an embodiment of the present invention, an electron emission source surface treatment material includes a solution that can be cured into a film using a heat treatment. The surface treatment material may be a polyimide group polymer, for example. The surface treatment material is coated on the heat treated resultant material and is heat treated. Then, the heat treated film is delaminated. According to anther embodiment of the present invention, an adhesive part is formed on the surface of a roller device that drives with a predetermined driving source such that the surface of the heat treated resultant material is compressed by a predetermined pressure. Thus, an activating operation can be performed. Through this activating operation, the carbon-based material can be controlled so as to be exposed to the surface of the electron emission source or so as to be aligned vertically.

If a heat treatment resultant material is not made from the composition including silicon-based material as described herein, the heat treatment resultant material can be delaminated from the substrate when it is subjected to the activating process as described above. However, a composition for forming electron emission sources according to an embodiment of the present invention includes silicon-based material as described above, and thus, in the activating process, the composition for forming electron emission sources is not delaminated from the substrate.

Accordingly, when the composition for forming electron emission sources according to an embodiment of the present invention is used, an undesirable phenomenon accompanied with forming an electron emission source such as delamination from the substrate in the process of the activating operation can be minimized. Thus, the product failure rate can be remarkably reduced. Also, material loss can be prevented.

The electron emission source according to an embodiment of the present invention may be an electron emission source formed using a method of forming an electron emission source.

An electron emission device according to an embodiment of the present invention includes a first substrate, a cathode and an electron emission source formed on the first substrate, a gate electrode arranged so as to be insulated electrically from the cathode, and an insulating layer arranged between the cathode and the gate electrode to insulate the cathode and the gate electrode. The electron emission source includes carbon-based material as described above and the cured and heat treated silicon-based material as described above. Further, the electron emission source may be an electron emission source using the method of forming an electron emission source according to the embodiment of the present invention described above.

The electron emission device may further include a second insulating layer formed on an upper surface of the gate electrode. In addition, various changes can be made. For example, as the gate electrode is insulated by the second insulating layer, the electron emission device may further include a focusing electrode arranged to be parallel with the gate electrode.

The electron emission device can be used as a backlight unit, etc. of various electrical devices, such as, for example, liquid crystal displays (LCDs), etc., or can be used in electron emission display devices.

An electron emission display device according to an embodiment of the present invention may include a first substrate, a plurality of cathodes arranged on the first substrate, a plurality of gate electrodes arranged so as to intersect the cathodes, an insulating layer arranged between the cathodes and the gate electrodes to insulate the cathodes and the gate electrodes, an electron emission source hole formed where the cathodes and the gate electrodes intersect each other, an electron emission source arranged in the electron emission source hole, a second substrate arranged parallel to the first substrate, an anode arranged on the second substrate and a phosphor layer on the anode. Here, the electron emission source includes carbon-based material as described above and the cured and heat treated silicon-based material. Further, the electron emission source may be an electron emission source formed using a method of forming an electron emission source according to an embodiment of the present invention as described above.

Figure 2:
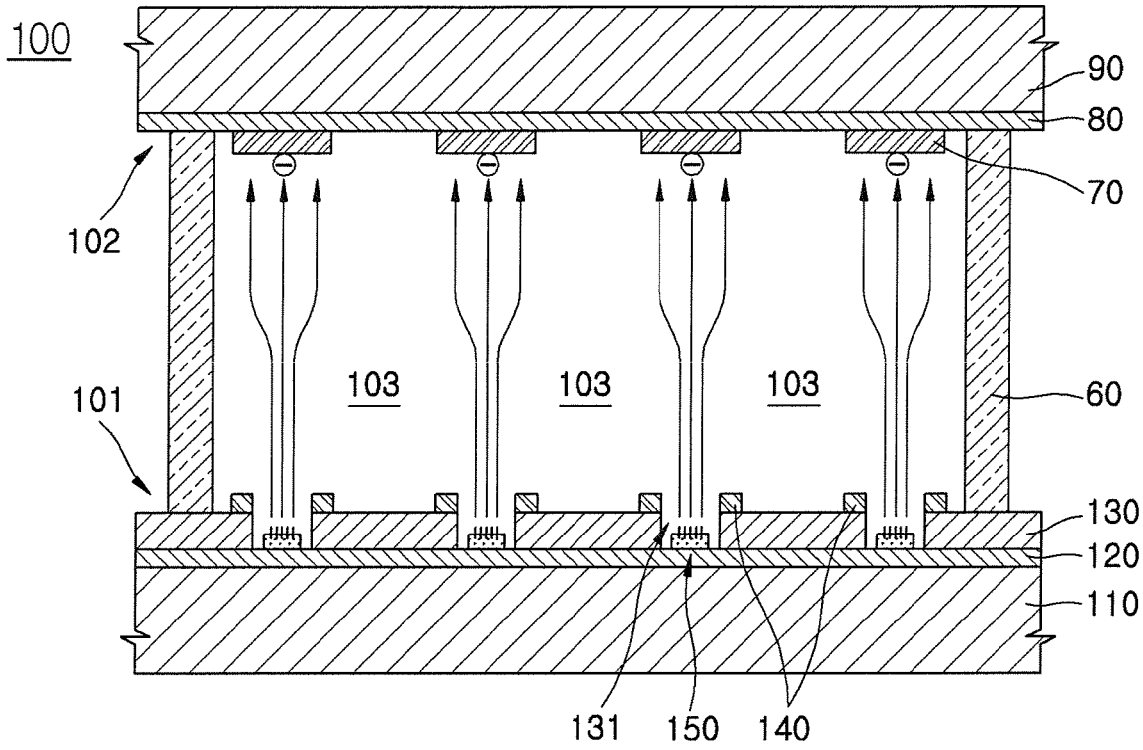
FIG. 2 is a cross-sectional view of the top gate type electron emission display device taken along a line II-II in FIG. 1.

FIG. 1 is a schematic perspective view of a top gate type electron emission display device 100 according to an embodiment of the present invention. FIG. 2 is a cross-sectional view taken along a line II-II of FIG. 1.

Referring to FIGS. 1 and 2, the top gate type electron emission display device 100 includes an electron emission device 101 and a front panel 102 which are arranged to be parallel and are spaced apart from each other by a predetermined distance. A vacuum light emission space 103 is formed between the electron emission device 101 and the front panel 102, and a spacer 60 maintains a predetermined distance between the electron emission device 101 and the front panel 102.

The electron emission device 101 includes a first substrate 110, a plurality of gate electrodes 140 and a plurality of cathodes 120 which are arranged to cross each other, and an insulating layer 130 interposed between the gate electrodes 140 and the cathodes 120 to electrically insulate the gate electrodes 140 and the cathodes 120.

Electron emission source holes 131 are formed where the gate electrodes 140 and the cathodes 120 cross each other. An electron emission source 150 is included in the electron emission source holes 131.

The front panel 102 includes a second substrate 90, an anode 80 arranged on a lower surface of the second substrate 90, and a phosphor layer 70 arranged on a lower surface of the anode 80.

Although aspects of the present invention have been described with reference to the top gate type electron emission display illustrated in FIGS. 1 and 2, embodiments of the present invention can also include electron emission displays with different structures such as, for example, an electron emission display including an additional insulating layer and/or a focusing electrode.

Hereinafter, aspects of the present invention will be described in greater detail with reference to the following examples. The following examples are for illustrative purposes only and are not intended to limit the scope of the invention.

EXAMPLE 1

Figure 3:
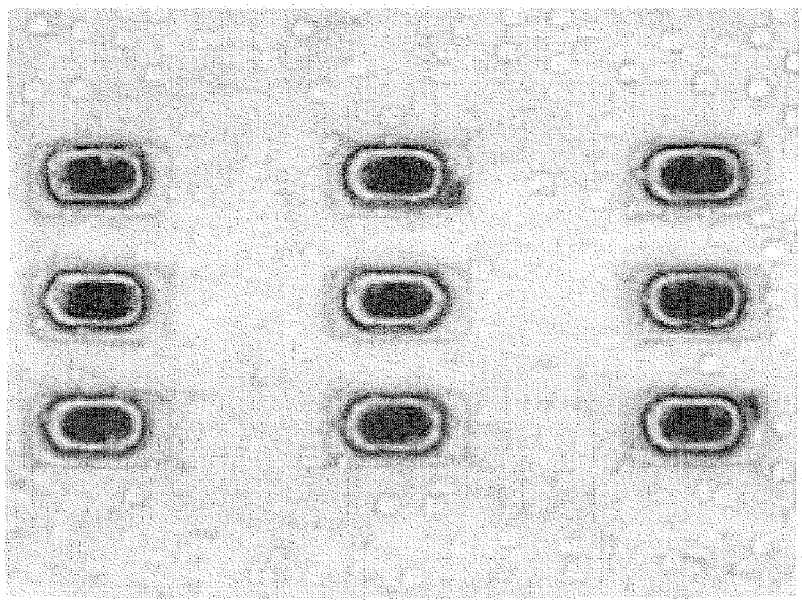
FIGS. 3 and 4 represent photographic images of electron emission sources observed by an optical microscope according to various embodiments of the present invention.

First, 1 g of carbon nanotube powder (available from CNI), 0.2 g of glass frit (8000 L, Shinheung Ceramics), 0.5 g of dichloro octamethyl tetra siloxane (the compound of formula (2a), molecular weight: 351), 5 g of a polyester acrylate (ELVACITE® 2045, a polyester acrylate available from Lucite International, Inc.), and 5 g of benzophenone were added to 10 g of terpineol and stirred to prepare a composition for forming electron emission sources having a viscosity of 30,000 cps. The composition was coated onto a substrate on which a Cr gate electrode, an insulating layer and an ITO cathode were formed. Then, the substrate was exposed with 2,000 mJ/cm$^2$ of exposing energy by an aligning exposure, and the electron emission source formation region on the substrate on which the composition for forming electron emission sources was coated, was cured. Thereafter, the substrate was developed using acetone and heat treated at a temperature of 450° C. and in a nitrogen gas atmosphere. 3M tape film was positioned on the surface of resultant material of the resulting substrate and then, the film was delaminated from the substrate. Also, an activating operation was performed. Thus, an electron emission source was formed. FIG. 3 represents a photographic image of electron emission sources according to Example 1 as observed by an optical microscope. Referring to FIG. 3, it can be seen that all of the electron emission sources are present on the substrate, indicating that none of the electron emission sources were removed by processes described in Example 1 such as the activating operation.

EXAMPLE 2

Figure 4:
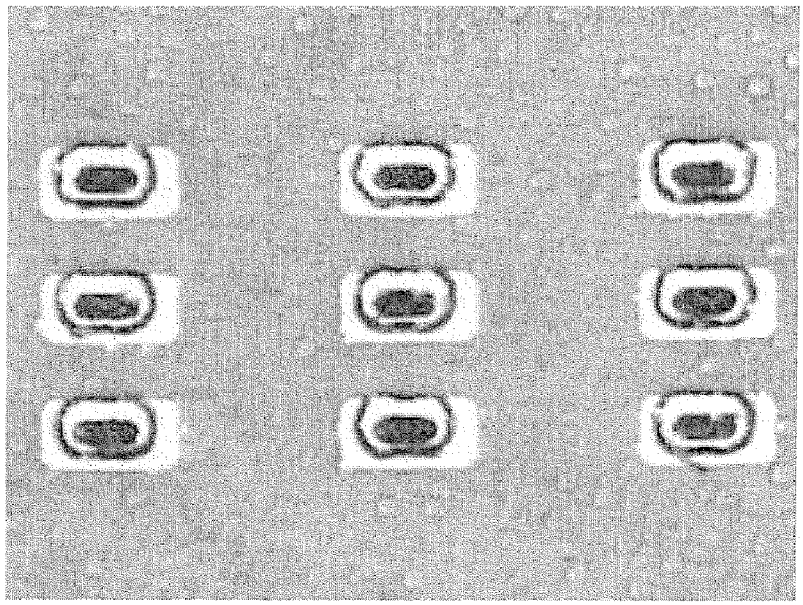

An electron emission source was formed using the same method as Example 1 except that hexamethyldisilizane (the compound of formula (3a), molecular weight: 161) was used instead of dichlorooctamethyl tetra siloxane. FIG. 4 is a photograph of electron emission sources observed by optical microscope according to Example 2 of the present invention. Referring to FIG. 4, it can be seen that all of the electron emission sources are present on the substrate, indicating that none of the electron emission sources were removed by the activating operation.

COMPARATIVE EXAMPLE

Figure 5:
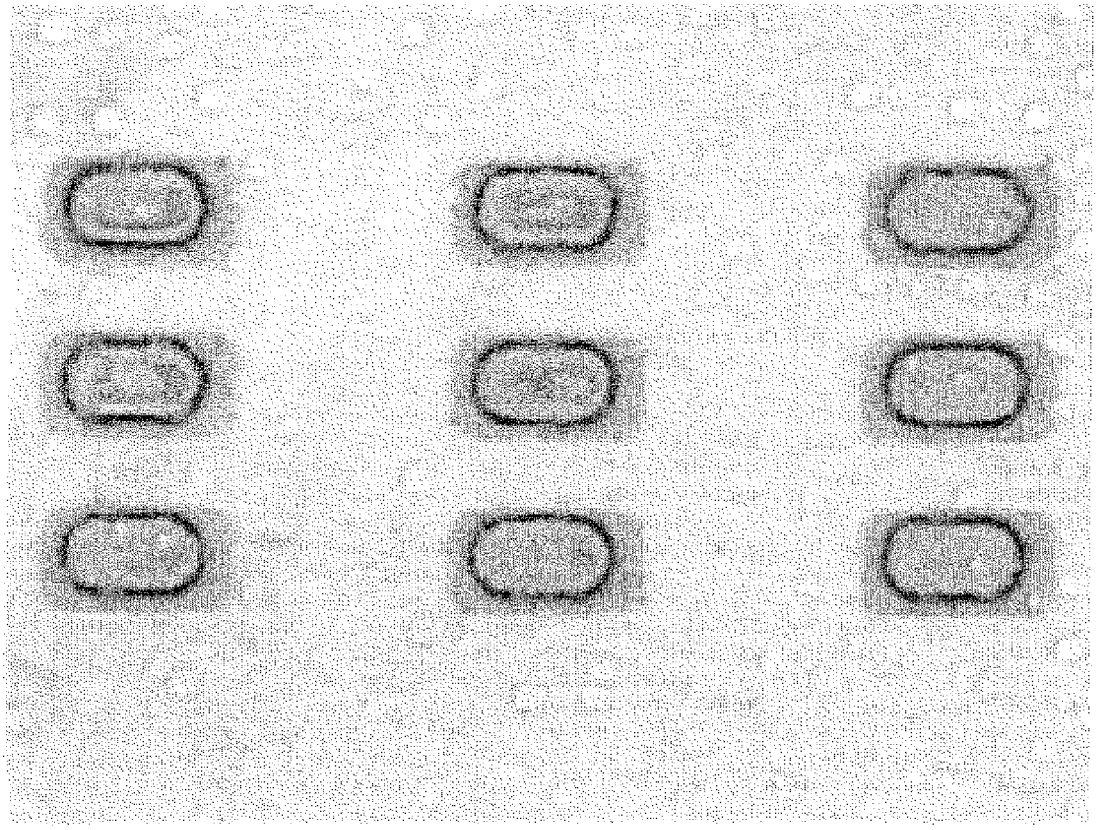
FIG. 5 represents a photograph image of an electron emission source according to a comparative example, as observed by an optical microscope.

An electron emission source was formed using the same method as Example 1 except that dichlorooctamethyl tetra siloxane was not added. FIG. 5 is a photograph of electron emission source observed by optical microscope as a comparative example.

Referring to FIG. 5, it can be seen that some of the electron emission source material was removed from the substrate after the activating operation An electron emission source according to an aspect of the present invention includes a carbon-based material, and a cured and heat treated silicon-based material, and thus, the adhesion of an electron emission source with a substrate can be increased. In addition, since an electron emission source according to an aspect of the present invention includes a carbon-based material and a silicon-based material, when the electron emission source is formed, the electron emission source can be adhered to a substrate firmly. Thus, the electron emission source is not delaminated from the substrate in the process of developing and activating the electron emission source. The electron emission device also has improved reliability.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electron emission source comprising a carbon-based material and a resultant material formed by curing and heat treating a silicon-based material, wherein the silicon-based material is at least one of a silicon-based material represented by formula (1) below and a silicon-based material represented by formula (2a) below:

formula (1)

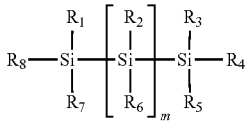

formula (2a)

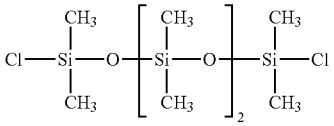

where $R_1$, $R_2$, $R_3$, $R_4$, $R_5$, $R_6$, $R_7$, and $R_8$, are each independently a substituted or unsubstituted $C_1$-$C_{20}$ alkyl group, a substituted or unsubstituted $C_1$-$C_{20}$ alkoxy group, a substituted or unsubstituted $C_1$-$C_{20}$ alkenyl group, a halogen atom, a hydroxyl group or a mercapto group, and m and n are each independently integers from 0 to 1,000.

2. The electron emission source of claim 1, wherein the silicon-based material has a weight average molecular weight of 100-100,000.

3. The electron emission source of claim 1, the $C_1$-$C_{20}$ alkyl group, the $C_1$-$C_{20}$ alkoxy group or the $C_1$-$C_{20}$ alkenyl group are substituted with at least one selected from the group consisting of an amino group, a hydroxyl group, a halogen atom, a carboxyl group, an epoxy group, a $C_1$-$C_{20}$ alkoxy group, and a $C_6$-$C_{10}$ cycloalkyl group.

4. The electron emission source of claim 1, wherein the silicon-based material is represented by formula (1a) below:

formula (1a)

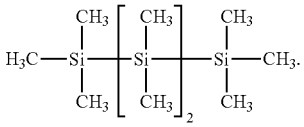

5. The electron emission source of claim 1, wherein the silicon-based material is represented by formula (2a) below:

formula (2a)

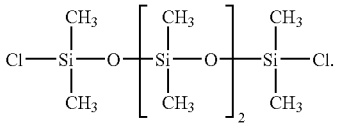

6. A composition for forming electron emission sources, the composition comprising:

a carbon-based material;

a silicon-based material; and a vehicle, wherein the vehicle comprises a photosensitive resin, a photoinitiator that initiates cross-linking of the photosensitive resin when exposed to light and a solvent, wherein the silicon-based material is at least one of a silicon-based material represented by formula (1) and a silicon-based material represented by formula (2):

formula (1)

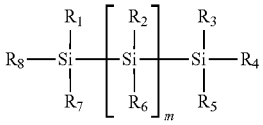

formula (2)

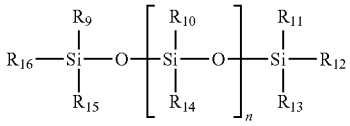

where $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, and $R_{16}$ are each independently a substituted or $C_1$-$C_{20}$ alkyl group, a substituted or unsubstituted $C_1$-$C_{20}$ alkoxy group, a substituted or unsubstituted $C_1$-$C_{20}$ alkenyl group, a halogen atom, a hydroxyl group or a mercapto group, and m and n are each independently integers from 0 to 1,000, and wherein the $C_1$-$C_{20}$ alkyl group, the $C_1$-$C_{20}$ alkoxy group or the $C_1$-$C_{20}$ alkenyl group are substituted with at least one selected from the group consisting of an amino group, a hydroxyl group, a halogen atom, a carboxyl group, an epoxy group, a $C_1$-$C_{20}$ alkoxy group, and a $C_6$-$C_{10}$ cycloalkyl group.

7. The composition for forming electron emission sources of claim 6, wherein the silicon-based material represented by formula (1) and the silicon-based material represented by formula (2) each have a weight average molecular weight of 100-100,000.

8. The composition for forming electron emission sources of claim 6, wherein the silicon-based material is represented by formula (1a) below:

formula (1a)

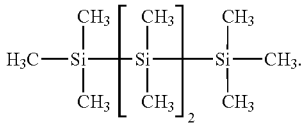

9. The composition for forming electron emission sources of claim 6, wherein the silicon-based material is represented by formula (2a) below:

formula (2a)

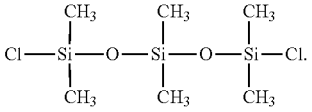

10. The composition of claim 6, wherein the viscosity of the composition is 3,000 to 50,000 cps.

11. The composition of claim 6, wherein the composition has an improved adhesion to a substrate and an improved resistance to delamination during development and activation processes in comparison to a composition for forming electron emission sources that does not include the silicon based material.

12. A composition for forming electron emission sources, the composition comprising:

a carbon-based material;

a silicon-based material; and a vehicle, wherein the vehicle comprises a photosensitive resin, a photoinitiator that initiates cross-linking of the photosensitive resin when exposed to light and a solvent, wherein the silicon-based material is at least one of a silicon-based material represented by formula (1) and a silicon-based material represented by formula (2):

formula (1)

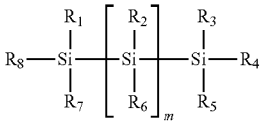

formula (2)

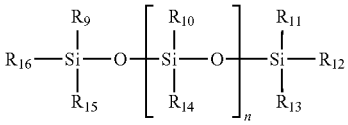

where $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, and $R_{16}$ are each independently a substituted or unsubstituted $C_1$-$C_{20}$alkyl group, a substituted or unsubstituted $C_1$-$C_{20}$alkoxy group, a substituted or unsubstituted $C_1$-$C_{20}$alkenyl group, a halogen atom, a hydroxyl group or a mercapto group, and m and n are each independently integers from 0 to 1,000, and wherein the amount of at least one of the silicon-based material represented by formula (1) and the silicon-based material represented by formula (2) is 20-400 parts by weight based on 100 parts by weight of the carbon-based material.

13. A method of forming an electron emission source, the method comprising:

preparing a composition for forming electron emission sources, the composition comprising:

a carbon-based material, a silicon-based material; and a vehicle, wherein the vehicle comprises a photosensitive resin, a photoinitiator that initiates cross-linking of the photosensitive resin when exposed to light and a solvent, wherein the silicon-based material is at least one of a silicon-based material represented by formula (1) and a silicon-based material represented by formula (2):

formula (1)

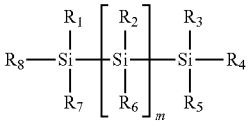

formula (2)

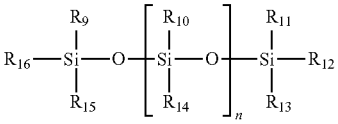

where $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, and $R_{16}$ are each independently a substituted or unsubstituted $C_1$-$C_{20}$ alkyl group, a substituted or unsubstituted $C_1$-$C_{20}$ alkoxy group, a substituted or unsubstituted alkenyl group, a halogen atom, a hydroxyl group or a mercapto group, and m and n are each independently integers from 0 to 1,000;

applying the composition for forming electron emission sources to a substrate; and heat treating the applied composition for forming electron emission sources on the substrate to a temperature between about 400° C. and 500° C.

14. The method of claim 13, wherein the applying of the composition for forming electron emission sources on the substrate provides a patterned electron emission source and is performed by curing and developing an electron emission source formation region after coating the composition for forming electron emission sources on the substrate.

15. An electron emission device comprising:

a substrate;

a cathode and an electron emission source arranged on the substrate;

a gate electrode disposed to be electrically insulated from the cathode; and an insulating layer arranged between the cathode and the gate electrode to insulate the cathode from the gate electrode, wherein the electron emission source is the electron emission source of claim 1.

16. The electron emission device of claim 15, further comprising:

a second insulating layer covering a upper surface of the gate electrode: and a focusing electrode that is insulated from the gate electrode by the second insulating layer, and is arranged to be parallel with the gate electrode.

17. An electron emission display device comprising:

a first substrate;

a cathode and an electron emission source arranged on the first substrate;

a gate electrode disposed to be electrically insulated from the cathode;

an insulating layer arranged between the cathode and the gate electrode to insulate the cathode from the gate electrode; and a second substrate arranged to be substantially parallel with the first substrate and comprising an anode and a phosphor layer;

wherein the electron emission source is the electron emission source of claim 1.

* * * * *

UNITED STATES PATENT AND TRADEMARK OFFICE

CERTIFICATE OF CORRECTION

PATENT NO. : 7,919,912 B2
APPLICATION NO. : 11/734393
DATED : April 5, 2011
INVENTOR(S) : Joo-Young Kim It is certified that error appears in the above-identified patent and that said Letters Patent is hereby corrected as shown below:

| | |
|---|---|
| Column 14, Claim 6, line 37 | After "substituted" Delete "or" |
| Column 14, Claim 6, line 38 | Delete "or unsubstituted" |
| Column 14, Claim 6, line 39 | Delete "or unsubstituted" |
| Column 15, Claim 9, line 2, formula (2a) | Delete |

"

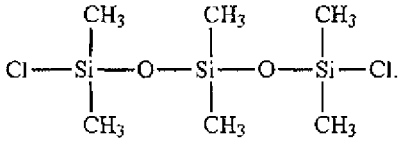

"

Insert

--

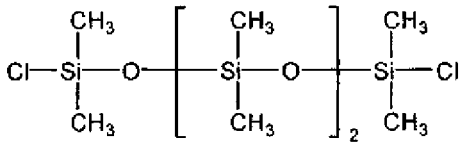

--

| | |
|---|---|
| Column 15, Claim 13, line 58 | Delete "material," Insert -- material; -- |
| Column 16, Claim 13, line 19 | Before "alkenyl" Insert -- $C_1$-$C_{20}$ -- |
| Column 16, Claim 16, line 47 | Delete "electrode:" Insert -- electrode; -- |

Signed and Sealed this
Third Day of April, 2012

David J. Kappos

David J. Kappos
*Director of the United States Patent and Trademark Office*